US005555991A

United States Patent [19]

Hart

[11] Patent Number: 5,555,991

[45] Date of Patent: Sep. 17, 1996

[54] PRODUCT-SUPPORTED ADVERTISING DISPLAY AND METHOD

[76] Inventor: Kevin A. Hart, Vent House, Charing, Ashford, Kent TN27 OHH, England

[21] Appl. No.: 213,803

[22] Filed: Mar. 16, 1994

Related U.S. Application Data

[63] Continuation-in-part of Ser. No. 19,638, Mar. 8, 1994, Pat. No. Des. 358,847.

[30] Foreign Application Priority Data

Sep. 17, 1993 [GB] United Kingdom ..... 2033955

[51] Int. Cl.[6] ..... A47F 5/00

[52] U.S. Cl. ..... 211/73; 248/174; 206/45.28

[58] Field of Search ..... 211/73, 59.4, 132; 248/174; 206/45.28, 44, 44.11; 40/606

[56] References Cited

U.S. PATENT DOCUMENTS

| | | | |
|---|---|---|---|
| Re. 32,668 | 3/1988 | Smith . | |
| 1,508,337 | 9/1924 | Jensen | 206/45.28 |
| 1,938,919 | 12/1933 | Marsh . | |
| 1,968,880 | 8/1934 | Ebert | 248/174 X |
| 2,108,096 | 2/1938 | Barsi . | |
| 2,801,754 | 8/1957 | Dorfman . | |
| 2,964,169 | 12/1960 | Brachman | 206/45.28 X |
| 3,380,181 | 4/1968 | Karel . | |
| 4,148,427 | 4/1979 | Baker | 248/174 X |
| 4,197,939 | 4/1980 | Dogliotti | 248/174 X |
| 4,582,195 | 4/1986 | Carstens . | |
| 4,705,162 | 11/1987 | Kupersmit | 206/44.11 X |
| 4,756,409 | 7/1988 | Munay | 211/73 X |
| 5,230,423 | 7/1993 | Gellatly | 206/44 R X |
| 5,259,578 | 11/1993 | Jones . | |

*Primary Examiner*—Robert W. Gibson, Jr.
*Attorney, Agent, or Firm*—Brinks Hofer Gilson & Lione

[57] ABSTRACT

A product-supported advertising display including a display base having a lower display skirt and a product display seat. The advertising display has an upright display face coupled to the display base for prominently displaying advertising indicia. The display is supported by a packaged product and may even support further products or packages. A second embodiment includes a display frame and flanges for insertion within the packaged product to support the display. A method of supporting the display device using a plurality of packaged products, and supporting and displaying the packaged product, is also provided.

24 Claims, 9 Drawing Sheets

PRODUCT-SUPPORTED ADVERTISING DISPLAY AND METHOD

This application is a continuation-in-part of application Ser. No. 29/019,638 filed Mar. 8, 1994, now U.S. Pat. No. 358,847 the contents of which are hereby incorporated by reference.

BACKGROUND OF THE INVENTION

The present invention relates generally to point of sale advertising displays, and more particularly to a point of sale advertising display supported by and supporting the product being advertised.

Many supermarkets and other retail establishments display products for sale using various types of displays. To induce customers to purchase their products, supermarkets and retail outlets try to display their products in an attractive manner. When determining whether to use an advertising display in connection with the product for sale, supermarkets and retail outlets consider many factors including the amount of space the advertising displays require, the ease and speed of assembly, the ease of storage, display durability, and the impact of the display on the consumer. On the other hand, product and advertising display manufacturers are concerned with the cost of manufacturing the displays, acceptability of the displays by the sales-force, approval of the displays by the retailers, as well as the impact of the displays on the customers.

Supermarkets and retail businesses have used conventional floor-standing merchandising displays or other display devices adapted to rest on a shelf, counter, or similar supporting surface in connection with the sale of products. Such displays are self-supporting and ordinarily used for displaying and holding individual articles or for advertising products arranged, displayed or stacked nearby. However, these display stands can be wasteful of valuable floor or counter space, relatively expensive, time consuming to assemble, and difficult to collapse or fold into a reasonable size for packaging and shipping. These display stands are also prone to be accidentally knocked over by customers who visit the store. Moreover, many small businesses simply do not have ample space to display independent floor-standing or counter devices and would rather use the space to display the actual products for sale.

Supermarkets and other retail outlets have also utilized display devices configured to be supported by individual products. However, some of these display devices have to be assembled and placed upon each individual product, thereby requiring many display devices to be supplied with the product. This technique is costly, time consuming and impractical. Such display devices also cover and deface or obscure the appearance of the individual products, and customers may have to remove the display devices to purchase each product. Customers who remove the display devices often throw them on the floor where they may become dirty and ruined, or even lost. Thus, employees of the supermarket have to police the products which use these individual display devices to make sure they have not been removed and replace those that have been removed.

Supermarkets and retail outlets usually display packaged products in a uniform manner. Stacks of cans, cartons, bottles, boxes or outer packs are a common sight in today's supermarkets and retail outlets. Ordinarily, the products are merely stacked on top of one another with some form of price card or other promotional message associated therewith. Furthermore, the supermarkets and retail outlets may cut open the top of the product package in order to display the individual products within the package. However, this arrangement alone is unimpressive and does not benefit from the combination of more effective advertising displays used in conjunction with the product being advertised. A display device that can be adapted for use directly with the packaged product, and provide external advertising for the product offered for sale, would be beneficial. Such a display device would further benefit from design simplicity, ease of assembly, and minimum costs.

SUMMARY OF THE INVENTION

In view of the above, the invention provides an advertising display that can be used with packaged products to display the packaged products in an attractive manner with the aid of advertising indicia. The invention contemplates the use of the product itself to support the advertising display. The display may take also alternate embodiments that support additional products, which serve to stabilize the display in position over the supporting product. The advertising displays of the invention are preferably inexpensive, lightweight to allow for convenient storing and handling, easy to assemble, stable, and can also be made to adapt to most packaged products.

According to the invention, an advertising display supported by a product is provided having an upright display face for prominently displaying advertising indicia. Means are provided for supporting the display back in cooperation with the product and for prominently displaying the product. In one preferred embodiment of the invention, the advertising display is formed from a single blank of corrugated material.

In another aspect of the invention, a product-supported point of sale advertising display comprises a display base, which is sized to rest on the packaged product and to support the packaged product. A display back is coupled to and extends upwardly from the display base for displaying advertising indicia. Means, coupled to the display base, are provided for supporting the display back in an upright position. In a preferred embodiment, opposing, upright display wings are provided to support the display back in an upright position.

In another aspect of the invention, a product-supported point of sale advertising display comprises a display frame supported by the packaged product and having first and second opposing arms. A display back capable of displaying advertising indicia is coupled between the first and second opposing arms. Means are provided, coupled to the display frame, for maintaining the display back in an upright position. In a preferred embodiment, first and second support flanges, coupled to and extending from the first and second opposing arms, insert within the packaged product. A tab, adapted for insertion within the packaged product, supports the display back in an upright position.

Another aspect of the invention relates to a method of advertising a packaged product. According to the method of the invention, a first packaged product is placed on a substantially level surface. An advertising display, having a display base or frame, is then assembled and seated or positioned upon the packaged product. A second package, configured to display the contents thereof, may then be positioned on the display base to secure the advertising display in position on top of the first packaged product.

Advertising displays made according to the invention allow supermarkets and other retail outlets to display packaged products in an effective and attractive manner, and to display the products contained in the package. These advertising displays allow supermarket and retail outlets to utilize the product itself in the display. According to the invention, the products also serve to support the display. Furthermore, these displays are preferably inexpensive to fabricate, light in weight, durable, stable, and easy to transport, store and assemble.

These and other features and advantages of the invention will become apparent to those skilled in the art upon a review of the following detailed description of the presently preferred embodiments of the invention, taken in conjunction with the appended drawings.

DETAILED DESCRIPTION OF THE PRESENTLY PREFERRED EMBODIMENTS

Figure 1:
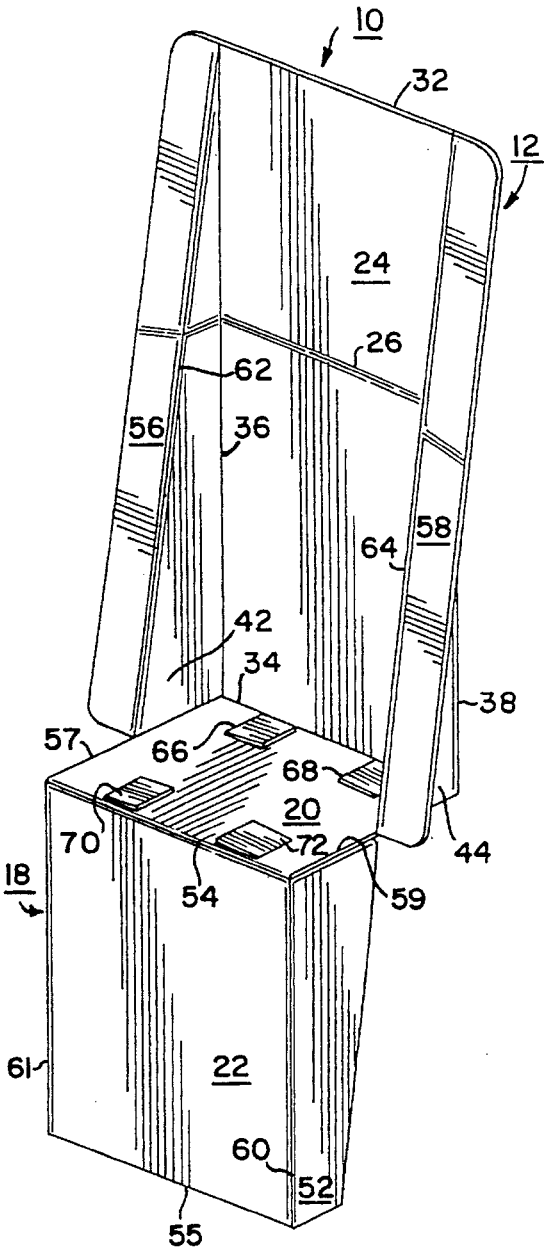
FIG. 1 a perspective view of one preferred embodiment of an advertising display made according to the invention.

Referring now to the drawings in detail, and particularly to FIG. 1, reference numeral 10 has been used to identify a product-supported advertising display constructed in accordance with one aspect of the present invention. The advertising display 10 generally comprises an upright display face 12 and a display base 18.

Figure 2:
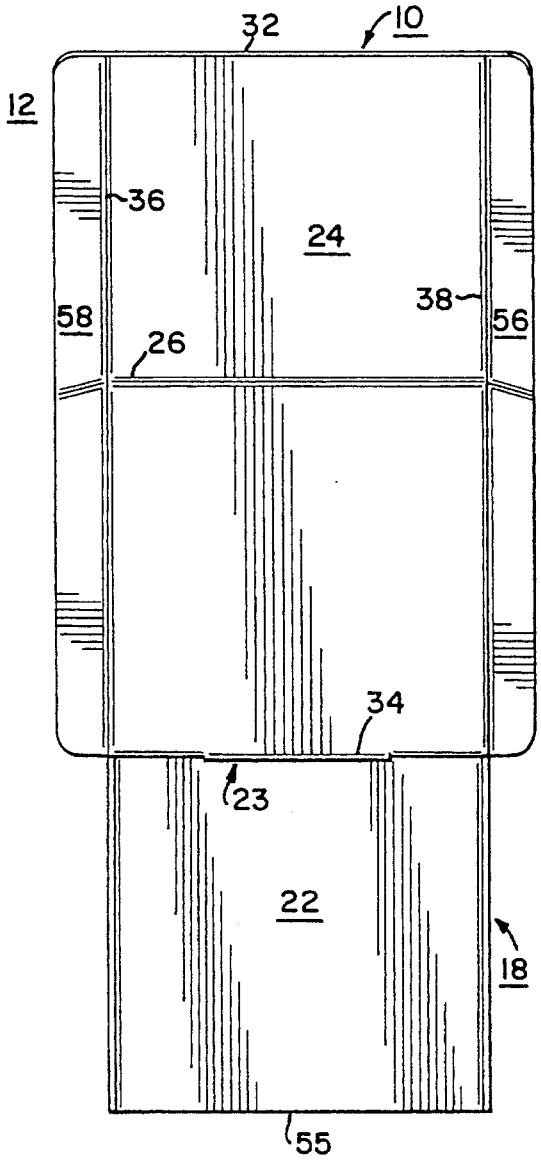
FIG. 2 is a back elevational view of the display shown in FIG. 1.

The upright display face 12 comprises a display back 24, a pair of opposing, upright display wings 42 and 44, and a pair of outer flanges 56 and 58. The display back 24 is generally of a rectangular configuration and is defined by a top end 32, and fold lines or creases 34, 36, and 38 (see FIG. 2). The opposing, upright display wings 42, 44 are foldably or hingedly connected to the display back 24 along fold lines 36 and 38. The outer flanges 56, 58 are foldably connected to the opposing, upright display wings 42, 44 along the fold lines or creases 62, 64. The outer flanges 56, 58 are positioned so that they are substantially perpendicular to the opposing, upright display wings 42, 44, as shown in FIG. 1.

Figure 3:
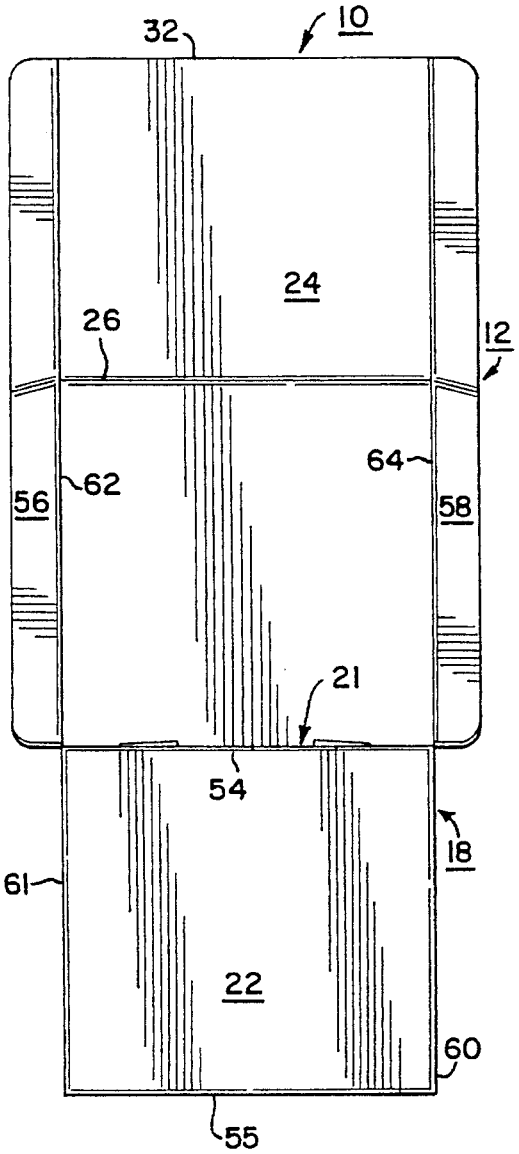
FIG. 3 is a front elevational view of the display shown in FIG. 1.

The display base 18 includes a display seat 20, a lower display skirt 22, and a pair of lower opposing display wings 50 (FIG. 4) and 52. The display seat 20 is preferably of a general rectangular configuration defined by fold lines 34 and 54 and opposing side edges 57 and 59. The display seat 20 includes a bottom side 23 (FIG. 2) sized to rest on a packaged product and a top side 21 (FIG. 3) sized to receive a packaged product (described in more detail below). The display seat 20 is connected to the display back 24 at fold line 34 and is similarly connected to the lower display skirt 22 at fold line 54. The lower display skirt 22 is defined by a bottom end 55 and fold lines 54, 61 and 60. The lower opposing wings 50, 52 (FIG. 4) are connected to the lower display skirt 22 along fold lines 61 and 60.

Figure 4:
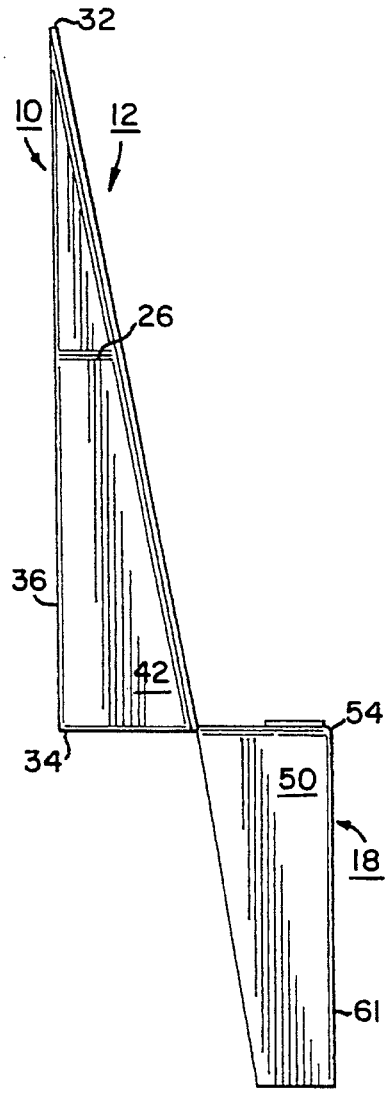
FIG. 4 is a right side elevational view of the display shown in FIG. 1.

Fold lines 36 and 38 allow the opposing, upright display wings 42, 44 to pivot relative to the display back 24, while fold lines 61 and 60 allow the lower opposing display wings to pivot relative to the lower display skirt 22. The opposing display wings 42, 44, 50 and 52, however, hold or secure the display seat 20 in a plane that is substantially perpendicular to the display back 24 and the lower display skirt 22. Although the opposing display wings 42, 44, 50 and 52 can take any desirable shape, the preferred form is a triangular or trapezoidal configuration, as shown in FIG. 4.

Figure 5:
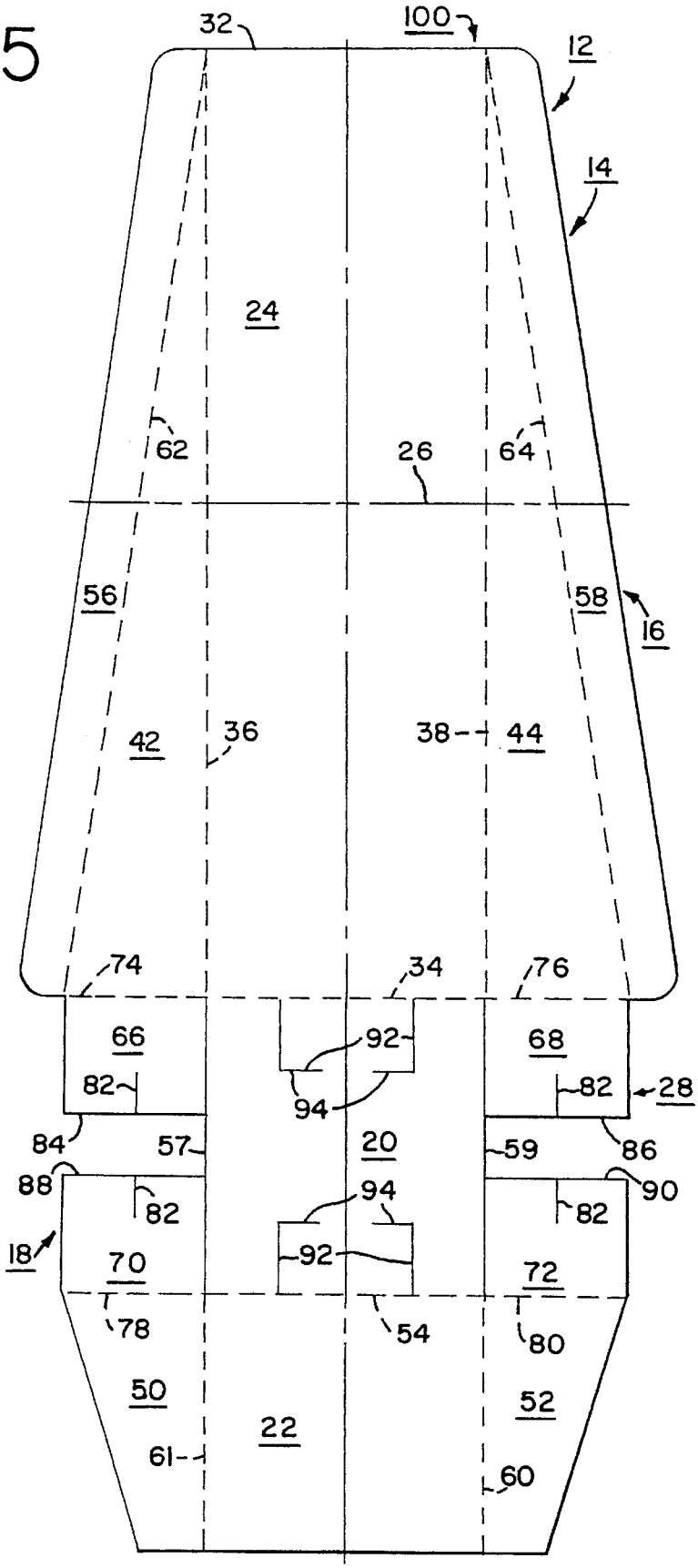
FIG. 5 is a plan view of one preferred unassembled blank employed in forming the display shown in FIG. 1.

FIG. 5 shows a presently preferred, unassembled blank 100 adapted for use in accordance with the invention. The blank 100 is generally of a rectangular configuration and is fabricated by conventional techniques from a suitable material which is capable of being creased, scored and folded such as cardboard, corrugated cardboard, plastic coated cardboard or other similar material. The fold lines or creases in the blank 100 of the invention are made by conventional techniques known in the art. Although the preferred embodiment of the invention is made from a single such blank 100, the various sections of the blank may be secured together by any conventional means known in the art such as adhesive, hot melt or staples.

To facilitate both assembly and storage of the advertising display, the blank 100 is divided into approximately three equal sections about fold lines 26 and 34 so as to provide a first section 14, a middle section 16, and a third section 28. Due to the fold lines or hinged connections, the advertising display may be collapsed so that the three sections are arranged in an adjacent parallel relationship. As a result, the advertising display can be folded flat for ease of transport and/or storage.

FIG. 5 further shows the means for securing the opposing display wings 42, 44, 50 and 52 to the display seat 20. The preferred securing means are flaps 66, 68 extending and foldably connected to the opposing, upright display wings 42, 44 along the fold lines 74, 76, and flaps 70, 72 extending and foldably connected to the lower opposing display wings 50, 52 along fold lines 78, 80. Each of these flaps 66, 68, 70 and 72 has an incision or slit 82, which extends perpendicular from a horizontal edge 84, 86, 88 and 90. Similarly, the display seat 20 has a pair of incisions or slits 92 extending from each fold line 34, 54 towards the center of the display seat 20, and a slit or incision 94 perpendicular thereto.

Figure 6:
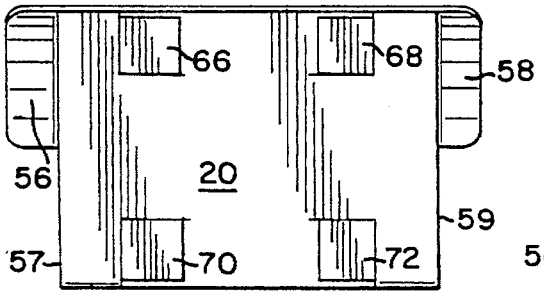
FIG. 6 is a top plan view of the display shown in FIG. 1.
Figure 7:
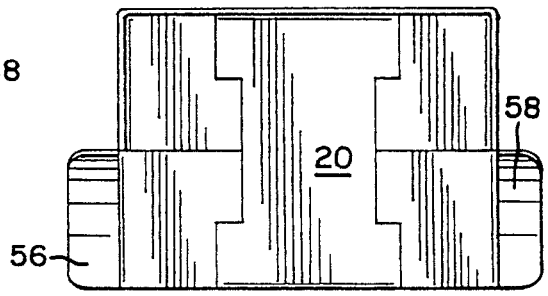
FIG. 7 is a bottom plan view of the display shown in FIG. 1.

The interconnection between the flaps 66, 68, 70 and 72 and the display seat 20 can be seen in the top and bottom plan views shown in FIGS. 6 and 7. Although flaps 66, 68, 70 and 72 are shown extending from the opposing display wings 42, 44, 50 and 52 to secure the opposing display wings 42, 44, 50 and 52 to the display seat 20, the flaps may also be an extension of the display seat 20. As those skilled in the art will appreciate, many variations are available for the arrangement of the flaps without departing from the spirit and scope of the invention.

Figure 10:
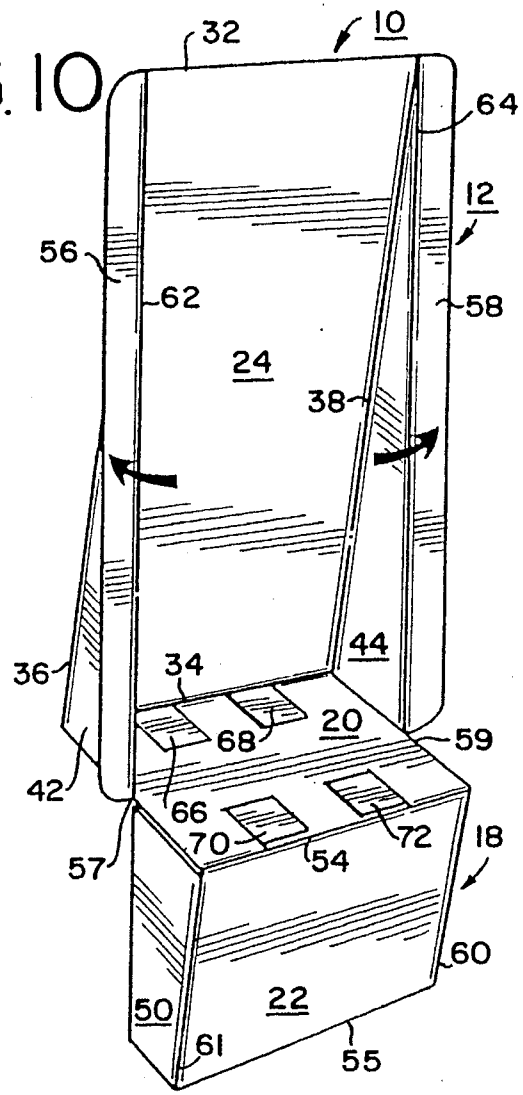
FIG. 10 is a perspective view showing the blank of FIG. 5 in its completely assembled condition.
Figure 9:
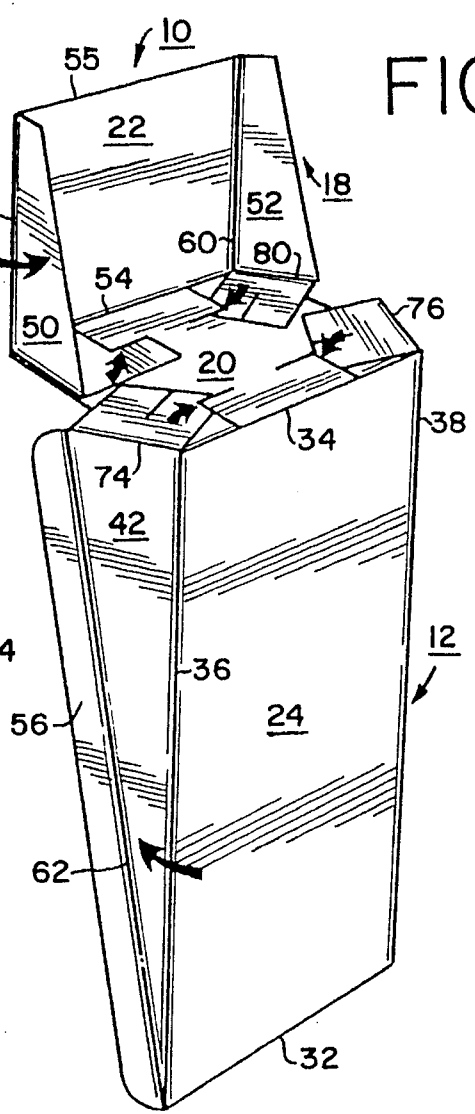
FIG. 9 is a perspective view showing the blank of FIG. 5 at a later stage in the assembly procedure.
Figure 8:
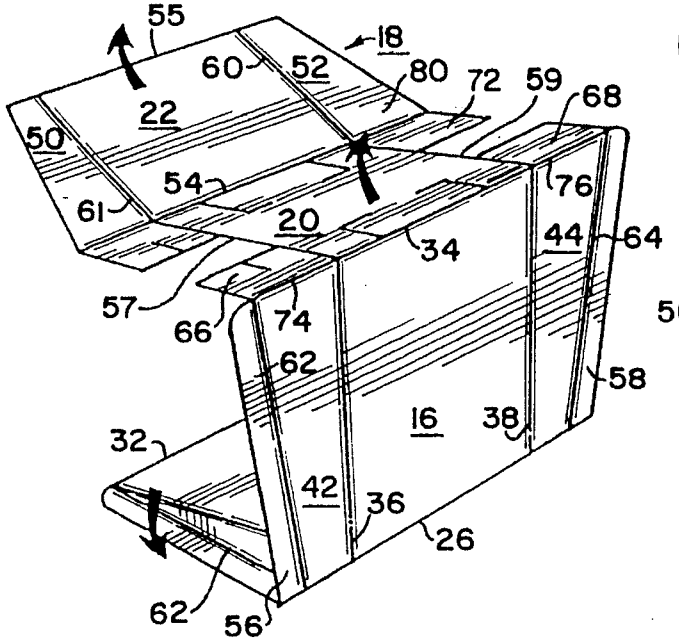
FIG. 8 is a perspective view showing the blank of FIG. 5 in an early stage of assembly.

Referring to FIG. 8, when the advertising display 10 is assembled from its collapsed position, the first section 14 is bent or folded about fold line or crease 26 to a position where the first section 14 and second section 16 lie in the same plane, thereby forming the upright display face 12 (FIG. 9). The display seat 20 is then folded along fold line 34 to a position perpendicular to the upright display face 12. Next, the lower display skirt 22 is folded to a position perpendicular to the display seat 20 and parallel to the display back 24, as shown in FIG. 9. The flaps 66, 68, 70 and 72 are folded so that they are at right angles to the opposing display wings 42, 44, 50 and 52. The opposing display wings 42, 44, 50 and 52 are then biased towards the center of the display seat 20 in order to engage the slits 82 of flaps 66, 68, 70 and 72 with the slits 92 and 94 of the display seat 20, thus causing the opposing display wings 42, 44, 50 and 52 to be secured or held perpendicular to the display seat 20. A firm interlock is attained whereupon the device 10 in its assembled condition (FIG. 10) may be positioned upon a packaged product and a packaged product secured on the display seat 20.

Figure 13:
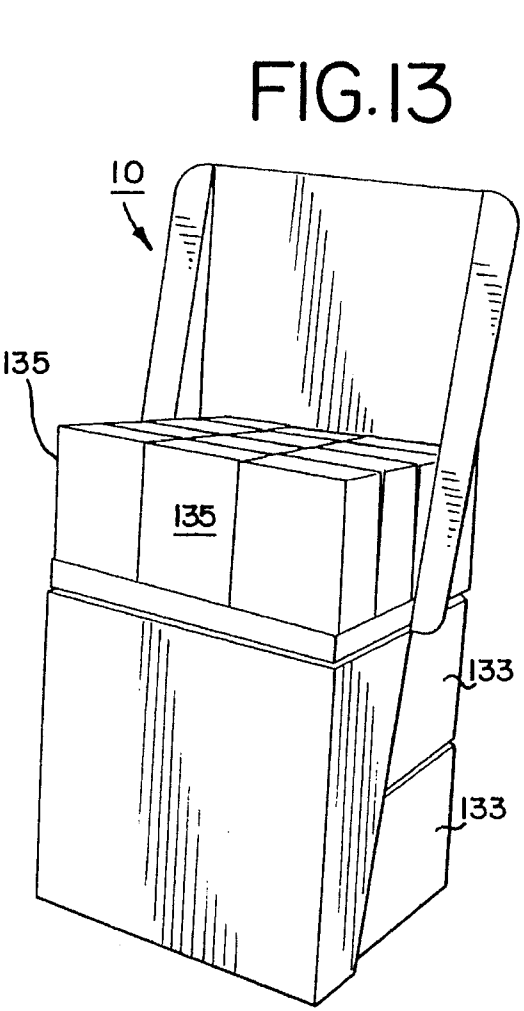
FIG. 13 is a perspective view showing the display shown in FIG. 1 in its assembled and set-up condition.
Figure 12:
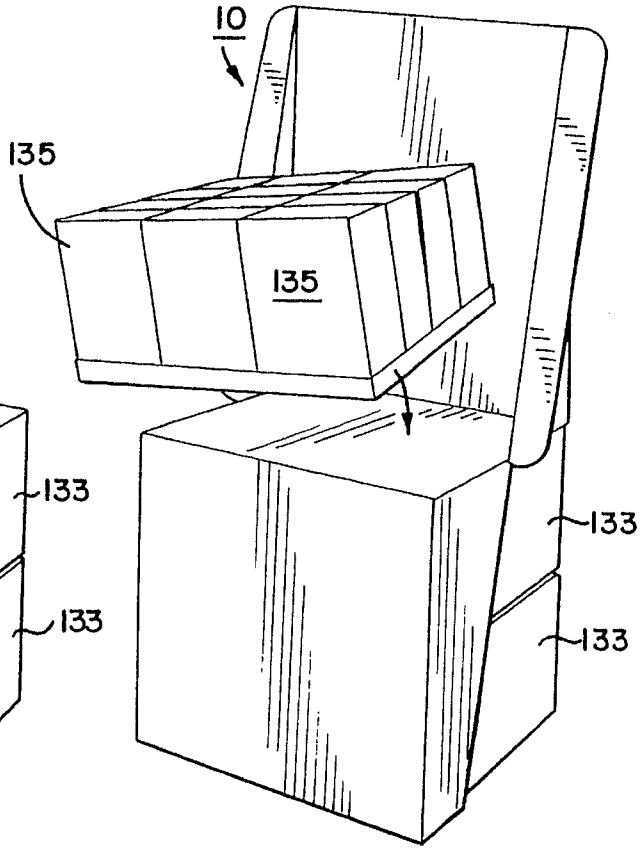
FIG. 12 is a perspective view showing another packaged product, configured to show its contents, being placed upon the display base.
Figure 11:
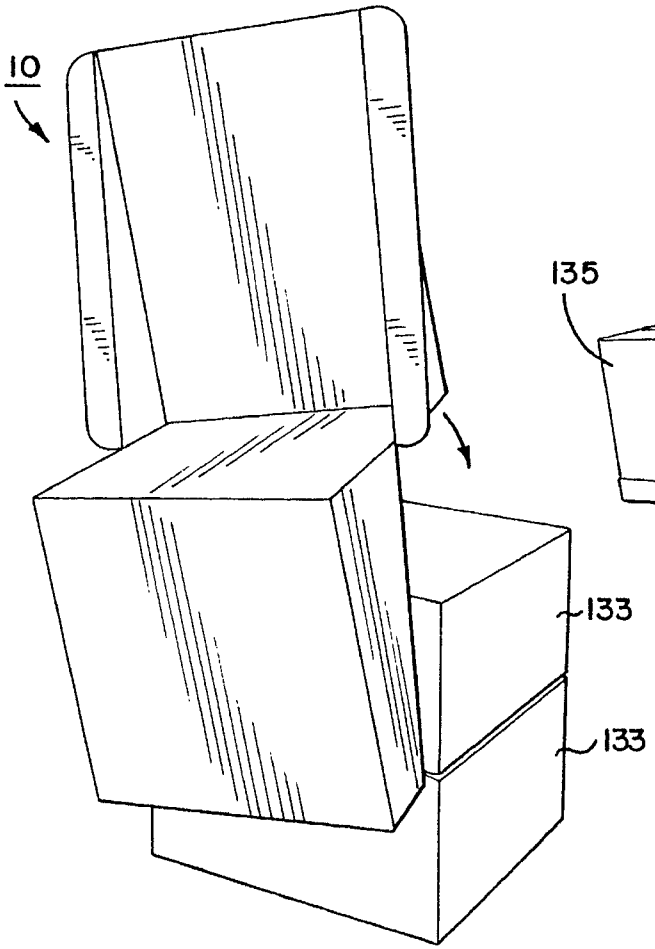
FIG. 11 is a perspective view of the display shown in FIG. 1 being placed upon a stack of packaged products.

Referring to FIGS. 11–13, a complete assembled display device 10 is shown, which can be adapted for use with a plurality of packages 133. Initially, one or more boxes 133 of the packaged product are stacked upon one another (FIG. 11). The advertising display 10 is then positioned on top of the upper packaged product 133. To ensure that the display 10 is securely seated and configured to advertise the product, one or more boxes 135 are then positioned or stacked on top of the display seat 20 (FIG. 12). These additional boxes can be partially opened to show the product as it appears in its packaged container 133. The display back 24 preferably projects upwardly and extends partially above the packages 135 supported by the display seat 20 (FIG. 13). Manufacturers can thus provide advertising indicia on the display back 24 to promote or call attention to the product being sold.

Figure 14:
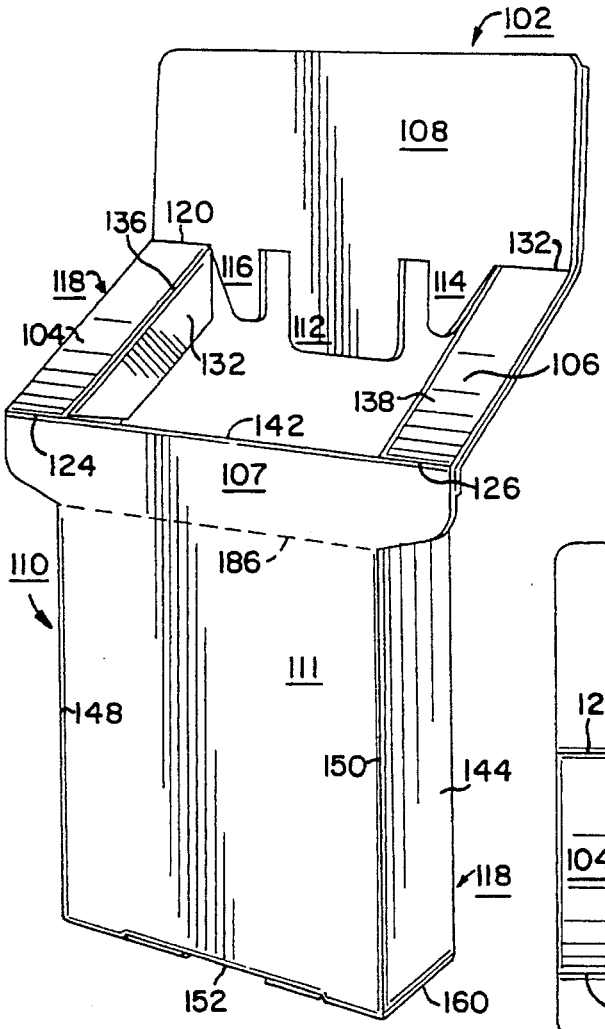
FIG. 14 is a perspective view of a second preferred embodiment of an advertising display made according to the invention.

Turning now to FIG. 14 of the drawings, a second preferred embodiment of the display device of the invention is identified as reference numeral 102. The advertising display 102 generally includes a display frame 118, a display back 108, and display skirt 110.

Figure 15:
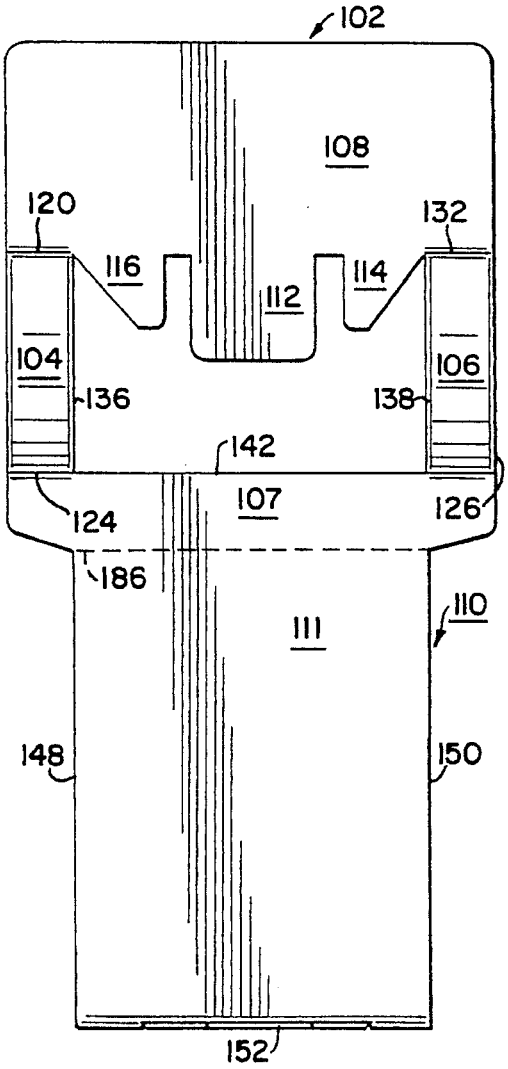
FIG. 15 is a front elevational view of the display shown in FIG. 14.
Figure 17:
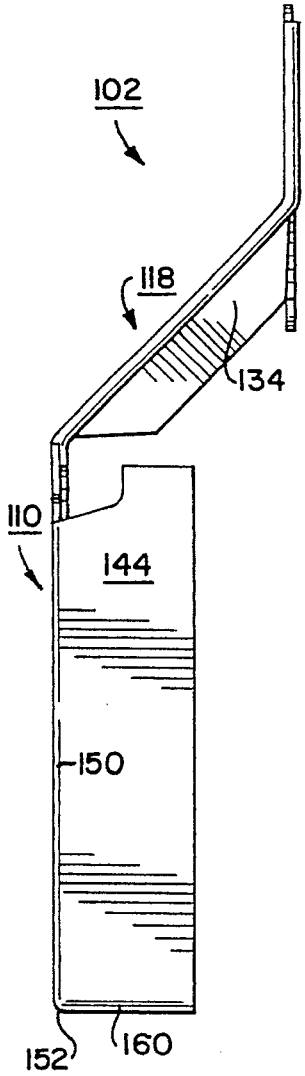
FIG. 17 is a left side elevational view of the display shown in FIG. 14.
Figure 16:
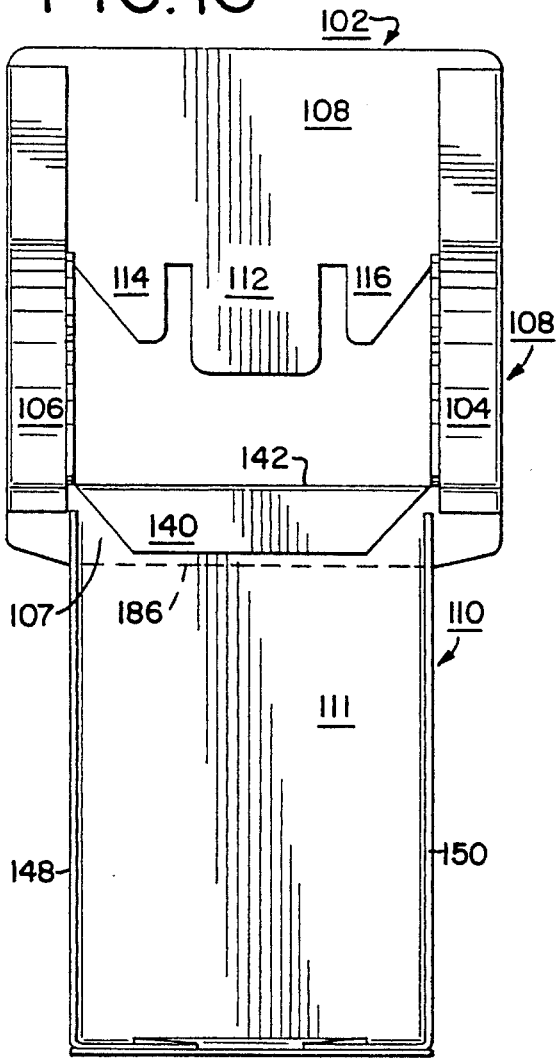
FIG. 16 is a back elevational view of the display shown in FIG. 14.

As shown, the display frame 118 has first and second frame or opposing arms 104, 106, and a front arm 107. The first and second opposing arms 104, 106 are foldably or hingedly connected to the display back 108 along fold lines 120 and 122, and foldably or hingedly connected to the front arm 107 at fold lines 124 and 126, as shown in FIG. 15. First and second depending flanges 132 and 134 (FIG. 17) are foldably or hingedly connected to the first and second frame arms 104, 106 at fold lines 136 and 138. Additionally, a front depending flange 140 is foldably or hingedly connected to the front arm 107 along fold line 142. Referring to FIG. 16, the front depending flange 140 is positioned parallel to the front arm 107.

The display back 108 also includes a tab 112 extending from the lower end of the display back 108 and sized for insertion in the packaged product (described below). The tab 112 is generally of a rectangular configuration, but can take any desirable shape without departing from the scope of the invention. The display back 108 further has two fins 114 and 116 extending downwardly, which lie in the same plane as, and cooperate with, the tab 112.

Figure 18:
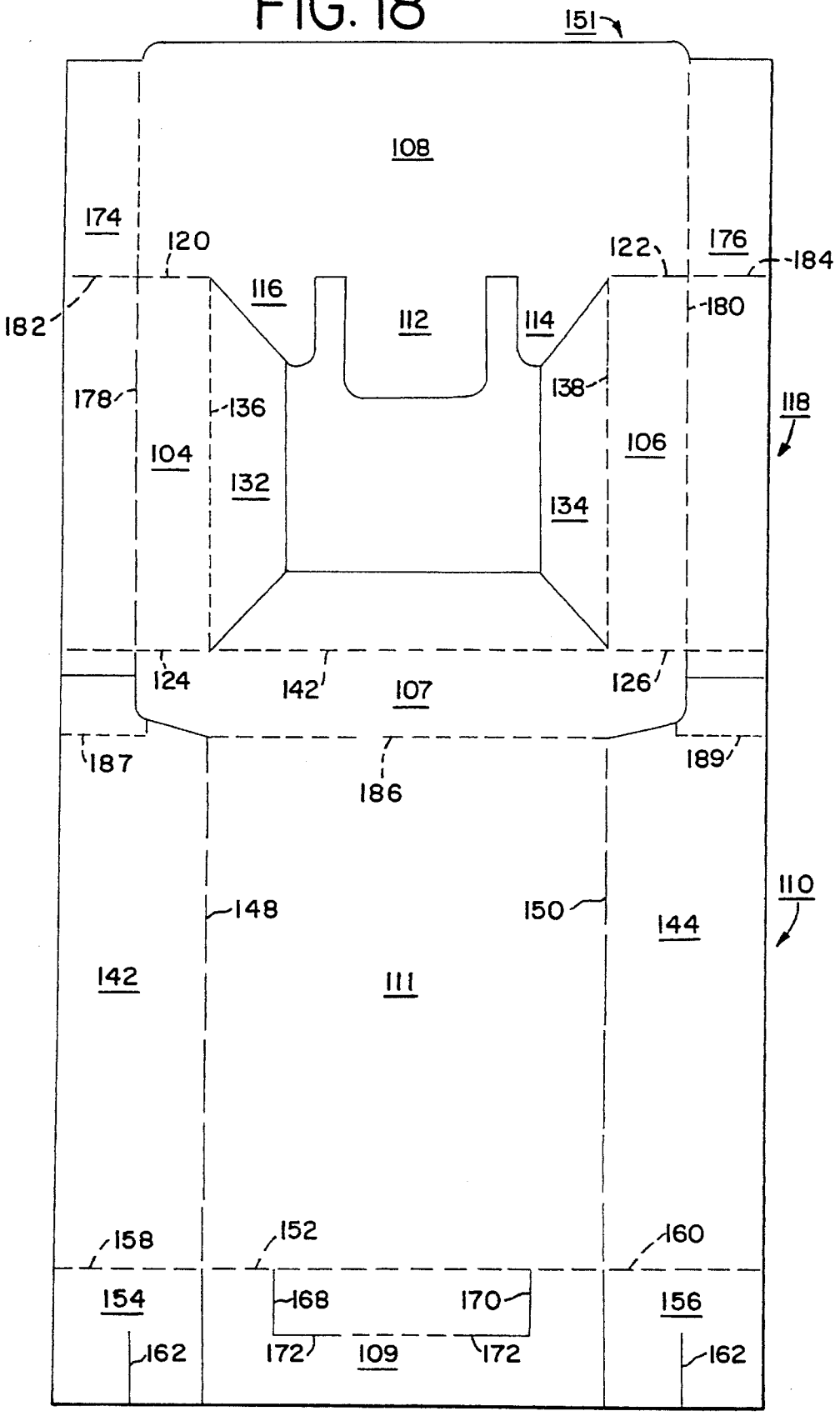
FIG. 18 is a plan view of one preferred unassembled blank employed in forming the display shown in FIG. 14.

The display skirt 110 includes a display front 111, a pair of opposing display wings 142, 144 and a lower display end 109 as shown in FIG. 18. The display front 111 is generally of a rectangular configuration and is defined by fold lines or creases 148, 150, 152 and 186. The opposing display wings 142, 144 are foldably or hingedly connected to the sides of the display front 111 along fold lines 148 and 150. The lower display end 109 is foldably or hingedly connected to the lower end of the display front 111 along fold line 152. Although the opposing display wings 142, 144 can take any desirable shape, the preferred form of the opposing display wings 142, 144 shown is a rectangular configuration. The fold lines 148, 150 and 152 allow the opposing display wings 142, 144 and lower display end 109 to pivot relative to the display front 111. The opposing display wings 142, 144 and lower display end 109, however, are held in a perpendicular relationship with respect to the display front 111, shown in FIG. 17.

FIG. 18 shows a preferred, unassembled blank 151 adapted to form the second preferred embodiment of the invention. The blank 154 is generally of a rectangular configuration and can be fabricated in the same manner as the blank 100 previously discussed in connection with FIG. 5.

FIG. 18 further shows the preferred mechanism for securing the display front 111 in perpendicular relationship with the opposing display wings 142, 144 and the lower display end 109. As shown, flaps 154 and 156 extend and foldably connect to the opposing display wings 142, 144 along fold lines 158 and 160. Each flap 154, 156 has an incision or slit 162 extending from a horizontal edge 164, 166. Similarly, the lower display end 109 has a pair of slits or incisions 168, 170 extending from fold line 152 towards the center of the lower display end 109. Another incision or slit 172 extends perpendicular to slits 168 and 170.

Figure 19:
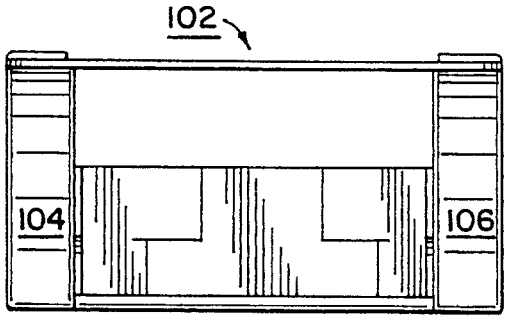
FIG. 19 is a top plan view of the display shown in FIG. 14.
Figure 20:
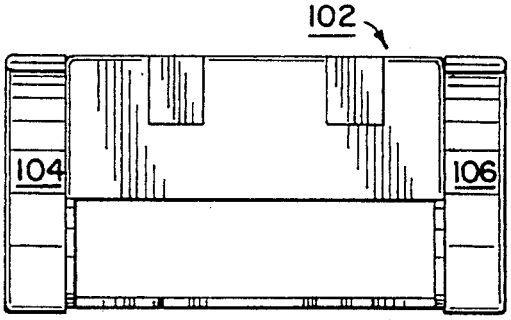
FIG. 20 is a bottom plan view of the display shown in FIG. 14.

The interconnection between the flaps 154, 156 and the lower display end 109 can be seen in the top and bottom plan views shown in FIGS. 19 and 20. Although FIGS. 19 and 20 illustrate flaps 154, 156 extending from the opposing display wings 142, 144 to secure the opposing display wings 142, 144 to the lower display end 109, the flaps 154, 156 may also be an extension of the lower display end 109. As those skilled in the art will appreciate, many variations of the flaps are available and are thus contemplated.

Referring again to FIG. 18, outer display sides 174 and 176 are foldably or hingedly connected to the display back 108 and first and second opposing arms 104 and 106 along fold lines 178 and 180. The outer display sides 174, 176 further have a fold or crease 182 and 184 in order to allow the outer display sides 174, 176 to conform to the preferably upright position of the display back 108 and the inclined position of the first and second opposing arms 104, 106 when the advertising display is assembled.

To store or transport the advertising display, the blank 151 is divided into two approximately equal sections about fold lines 186, 187 and 189. The advertising display can thus be folded flat for ease of transport and/or storage.

Figure 23:
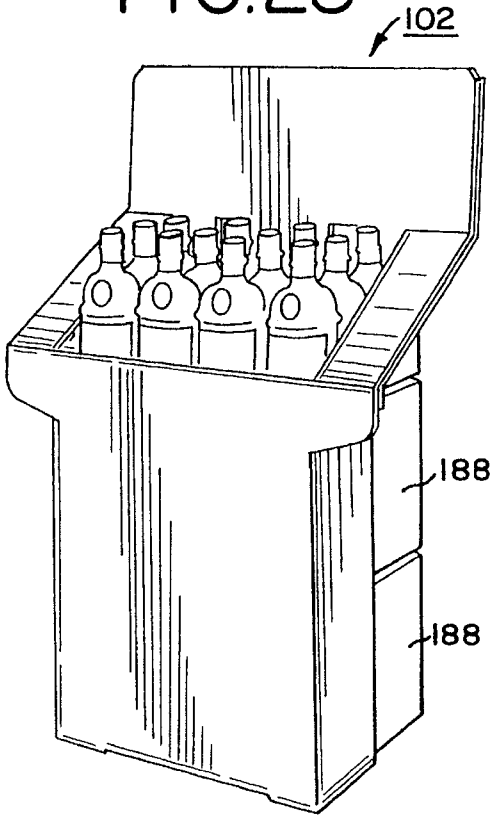
FIG. 23 is a perspective view of the display shown in FIG. 14 in its assembled and set-up condition.
Figure 22:
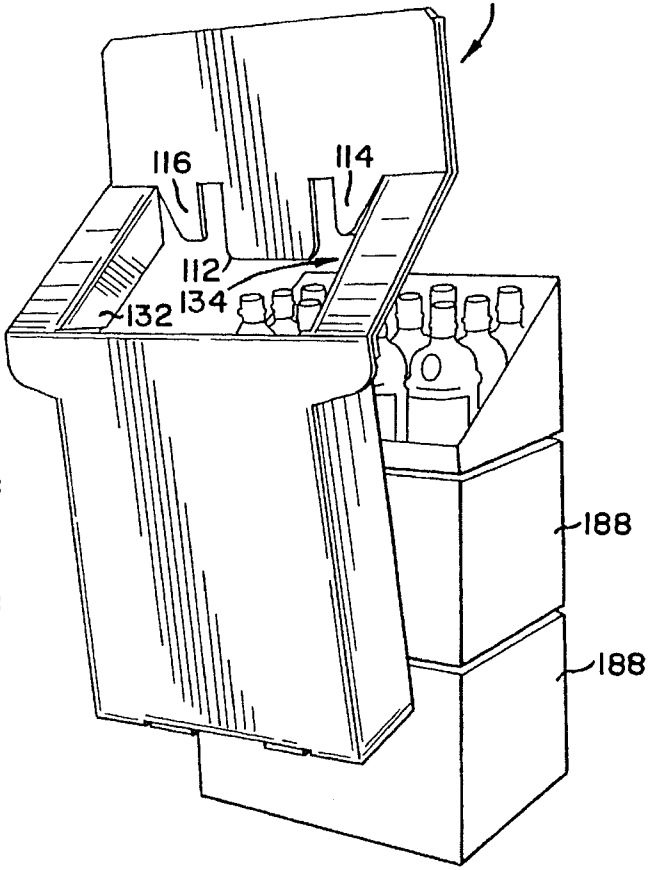
FIG. 22 is a perspective view of the display shown in FIG. 14 being placed upon the stacked packaged products shown in 21.
Figure 21:
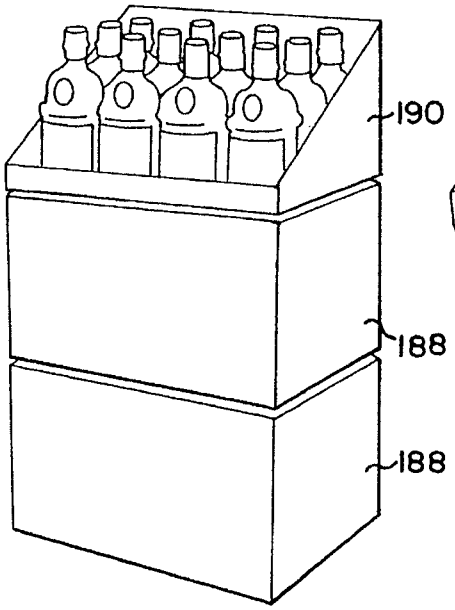
FIG. 21 is a perspective view of a plurality of stacked packaged products with the upper package configured to show its contents.

Referring to FIGS. 21–23, a complete assembled and erected display device 102 is shown, which is adapted to be supported by the packaged product. Initially, one or more boxes 188 of the packaged product are stacked upon each other (FIG. 21). The upper box 190 is preferably partially opened to display the product within the package, and the advertising display 102 is then secured to the packaged product by insertion of the flanges 132, 134, the tab 112 and the fins 114, 116 within the partially opened packaged product, as shown in FIGS. 22 and 23.

As can be seen, the invention provides an advertising display that is supported by, and in one embodiment supports, the packaged product. The advertising displays of the invention can be tailored to most package sizes and can be adapted to various types of packaged products. The advertising displays of the invention, therefore, allow a retailer to combine in one setting the product and effective advertising materials to display the product offered for sale. These advertising displays are inexpensive to construct, lightweight to allow for convenient storage and handling, easy to assemble, durable and stable.

Although the present invention has been described in detail by way of illustration and example, various changes and modifications may be made without departing in any way from the spirit of the invention and scope of the appended claims.

I claim:

1. A point of sale advertising display supported by a packaged product, comprising:

a display base, the display base sized to rest on top of at least one packaged product and to support the at least one packaged product;

a display back, the display back coupled to and extending upwardly from the display base and capable of displaying advertising indicia, the display back substantially larger than the display base; and opposing upright display wings coupled to the display base for supporting the display back in a substantially upright position.

2. A point of sale advertising display supported by a packaged product, comprising:

a display frame having first and second opposing arms, the display frame supported by the packaged product;

a display back coupled between and extending upwardly from the first and second opposing arms, the display back capable of displaying advertising indicia;

means, coupled to the display frame, for maintaining the display back in a substantially upright position; and a lower display skirt coupled to and extending downwardly from the display frame.

3. A point of sale display as recited in claim 2, wherein the means for maintaining comprises a tab extending from the display back for insertion within the packaged product.

4. An advertising display, comprising:

a lower packaged product;

a display base having a top and a bottom, the bottom sized to rest on the lower packaged product and the top sized to receive an upper packaged product to secure the display base in position over the lower packaged product;

a display back, the display back coupled to and extending upwardly from the display base and capable of displaying advertising indicia, the display back substantially larger than the display base; and first and second opposing upright display wings coupled to the display base and to the display back, the first and second upright display wings for supporting the display back in a substantially upright position.

5. An advertising display as recited in claim 4, wherein the upper packaged product is configured to display the product within its package.

6. An advertising display as recited in claim 4 further comprising a display skirt coupled to the display base, the display skirt sized to partially encompass the packaged product and capable of displaying advertising indicia.

7. An advertising display as recited in claim 4, wherein the lower packaged product comprises a plurality of packaged products arranged in a stacked configuration.

8. An advertising display, comprising:

a product container comprising at least one product;

a display frame having first and second frame arms, the display frame supported by the product container and positioned to frame the perimeter of the product container;

first and second support flanges, the first and second support flanges coupled to and extending from the first and second frame arms and sized for insertion within the product container;

a display back coupled between and extending upwardly from the first and second frame arms, the display back capable of displaying advertising indicia; and a tab projecting downwardly from the display back, the tab sized for insertion within the packaged product to support the display back in a substantially upright position.

9. An advertising display as recited in claim 8, wherein the product container is configured to display the product.

10. An advertising display as recited in claim 8 further comprising a display skirt coupled to the display frame, the display skirt sized to partially encompass the packaged product.

11. A method of advertising a plurality of packaged products, comprising the steps of:

placing a first packaged product on a substantially level surface;

assembling an advertising display comprising a display base sized to rest on top of the first packaged product and defining a display seat, and a display back substantially larger than the display seat;

seating the advertising display on top of the first packaged product; and positioning a second packaged product on the display seat to stabilize the display base on top of the first packaged product.

12. The method of advertising a plurality of packaged products as recited in claim 11 further comprising the step of configuring the second packaged product to display the product.

13. The method of advertising a plurality of packaged products as recited in claim 11, wherein the advertising display is formed from a single cut and scored blank.

14. A method of advertising a packaged product, comprising the steps of:

placing a partially opened packaged product on a substantially level surface;

assembling an advertising display comprising a display frame having first and second depending flanges and a display back having a depending tab;

positioning the display frame on top of the packaged product; and positioning the tab and the first and second depending flanges within the partially opened packaged product to anchor the display base on top of the packaged product and secure the display back in a substantially upright position.

15. The method of advertising a packaged product as recited in claim 14, wherein the advertising display is formed from a single cut and scored blank.

16. The advertising display as recited in claim 1, wherein the advertising display is formed from corrugated cardboard.

17. The advertising display as recited in claim 1, further comprising a display face having two opposing side edges, wherein the opposing upright display wings are coupled to substantially the length of one of the side edges.

18. A point of sale display as recited in claim 1 further comprising a lower display skirt, the lower display skirt coupled to and extending downwardly from the display base.

19. A point of sale display as recited in claim 18, wherein the lower display skirt is coupled to and extends downwardly from the front edge of the display base.

20. A point of sale display as recited in claim 18 further comprising a second pair of opposing upright display wings coupled to the display base and display skirt.

21. The point of sale advertising display as recited in claim 1, wherein each upright display wing comprises a flange for coupling the display wings to the display base.

22. The point of sale advertising display as recited in claim 21, wherein the display base comprises a plurality of slots, each slot receiving the adjacent flange of the upright display wing.

23. The point of sale advertising display as recited in claim 1, wherein the display base comprises two opposing side edges, the upright display wings being coupled to the side edges.

24. The point of sale advertising display as recited in claim 2, wherein the display frame is formed from a single display blank.

* * * * *